United States Patent [19]

Huguenin et al.

[11] 4,355,380

[45] Oct. 19, 1982

[54] ELECTRONIC TIMEPIECE WITH AUXILIARY DIGITAL DISPLAY

[75] Inventors: Freddy Huguenin, Lausanne; Jean-Pierre Wattenhofer, Neuchatel, both of Switzerland

[73] Assignee: Ebauches, S.A., Switzerland

[21] Appl. No.: 163,277

[22] Filed: Jun. 26, 1980

[30] Foreign Application Priority Data

Jun. 28, 1979 [CH] Switzerland ..... 6028/79

[51] Int. Cl.[3] ..... G04B 19/04; G04B 25/00

[52] U.S. Cl. ..... 368/71; 368/80; 368/82

[58] Field of Search ..... 368/82-84, 368/76, 71, 239-242

[56] References Cited

U.S. PATENT DOCUMENTS

| | | | |
|---|---|---|---|
| 3,911,665 | 10/1975 | van Berkum | 368/82 X |
| 4,198,810 | 4/1980 | Fahrenschon | 368/240 X |
| 4,236,240 | 11/1980 | Yoshida | 368/84 X |
| 4,247,930 | 6/1980 | Martin | 368/84 X |
| 4,255,806 | 3/1981 | Fahrenschon et al. | 368/84 X |

*Primary Examiner*—Vit W. Miska

*Attorney, Agent, or Firm*—Allegretti, Newitt, Witcoff & McAndrews, Ltd.

[57] ABSTRACT

An electronic timepiece with hands 1, 2 has a plurality of auxiliary digital displays 5, 6 and 7 for indicating the same parameter, e.g., the day of the month. Only the digital display not interfering, at a given moment, with the analog time display is activated by a control circuit which decodes which of three sectors a, b and c are occupied by the hands. The display in the unoccupied sector, or one of the two unoccupied sectors, is always selected.

2 Claims, 5 Drawing Figures

ELECTRONIC TIMEPIECE WITH AUXILIARY DIGITAL DISPLAY

BACKGROUND OF THE INVENTION

There are many timepieces with an auxiliary digital display for displaying, for example, the date or the day of the month. In timepieces of this kind, wherein the digital display is produced in the main dial area by a liquid crystal type display, the major disadvantage is that the hands of the timepiece, whether these are mechanical hands or, in particular, a pseudo-analog time display, as described for example in U.S. Pat. No. 3,959,963, are superimposed on the auxiliary digital display at many times of day and make it difficult or impossible to read the digital display.

The object of the present invention is to provide a timepiece comprising an analog or pseudo-analog time display and an auxiliary digital display, e.g., for the day of the month, wherein the time display never interferes with reading of the auxiliary display.

BRIEF SUMMARY OF THE INVENTION

According to the present invention, there is provided an electronic timepiece comprising an analog or pseudo-analog time display and a digital auxiliary display which comprises a plurality of display means disposed at different positions of the face of the timepiece in such a way that, irrespective of the time of day, at least one of the auxiliary display means is fully visible.

BRIEF DESCRIPTION OF THE DRAWINGS

The accompanying drawings diagrammatically illustrate, by way of example, two embodiments of a timepiece according to the invention. In the drawings.

Figure 1:
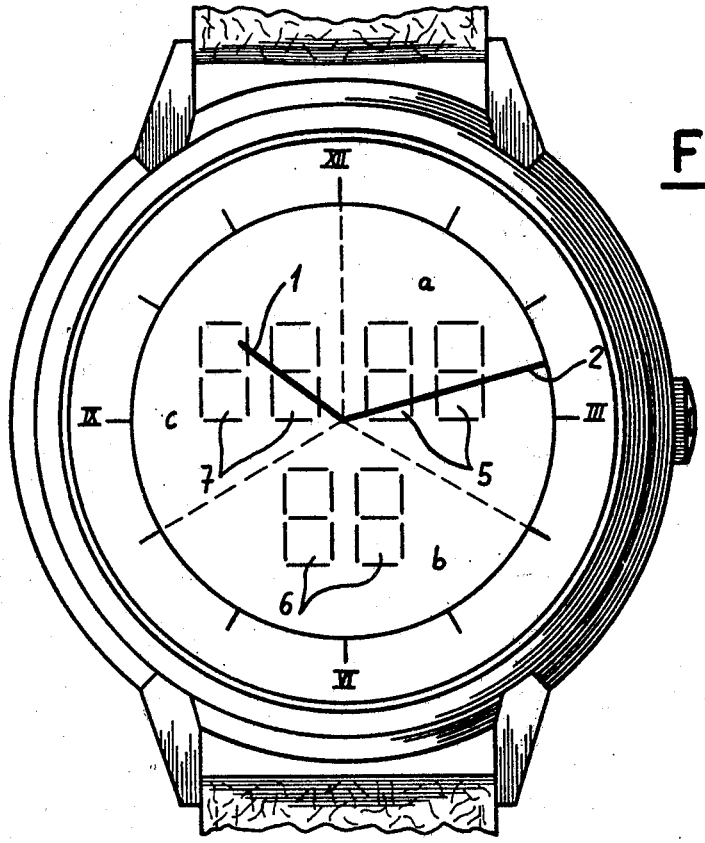
FIG. 1 is a diagrammatic view of a face provided with an analog or pseudo-analog time display and three auxiliary digital displays.
Figure 3:
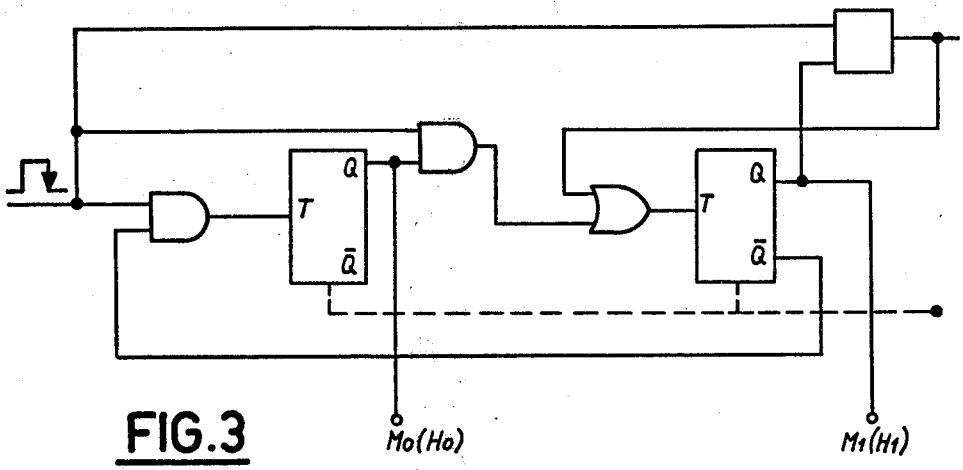
FIG. 3 is a detailed diagram of an illustrative circuit for division by a factor of three.
Figure 2:
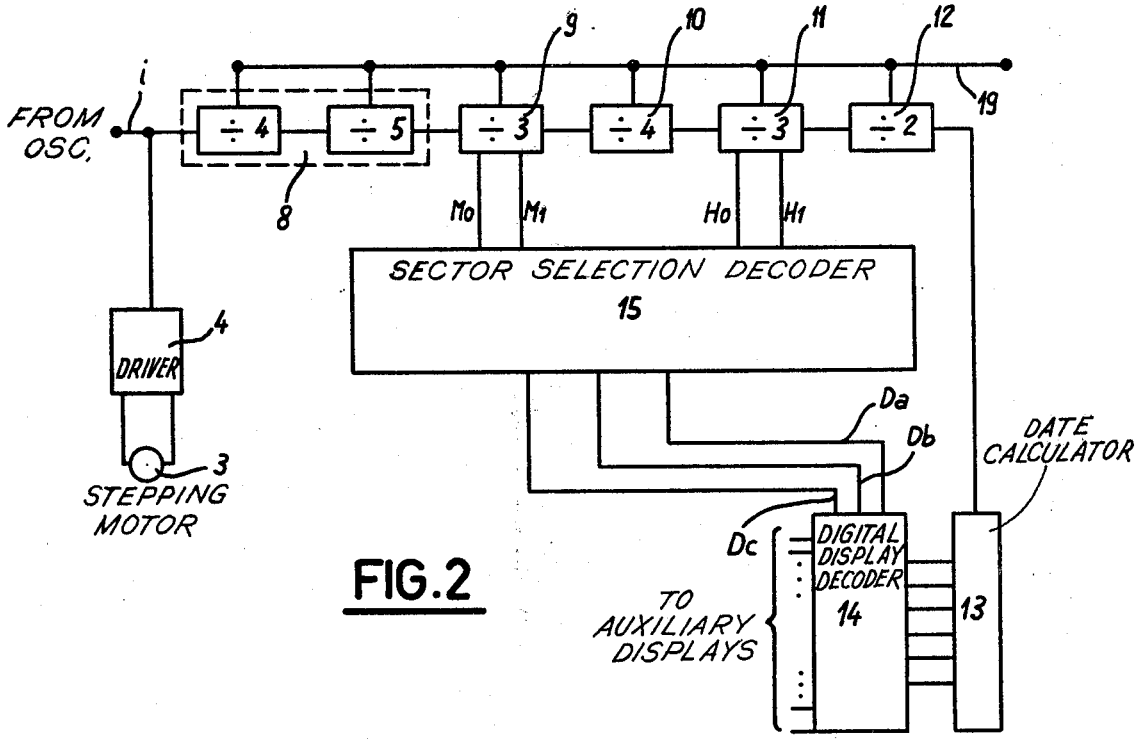
FIG. 2 is a block circuit diagram of part of a timepiece having a mechanical analog time display (hands) and three digital auxiliary displays.

In the first embodiment of the timepiece, specifically a watch, illustrated in FIGS. 1 to 3, the time display of the watch comprises two mechanical hands 1 and 2 which are driven by a stepping motor 3 which is continuously fed by a driver 4 receiving the output pulses i of the oscillator circuit (not shown) of the watch, at a rate of one pulse per minute for example. The face of the watch is notionally divided into three equal 120°-angle sectors a, b and c.

The watch also comprises three auxiliary two-digit LCD displays 5, 6 and 7 which are each disposed in a respective one of the three sectors, a, b and c of the face of the watch.

Irrespective of the time displayed, at a given time the hands can only be positioned in two of the sectors at the most. The auxiliary display which is positioned in the third sector is therefore entirely clear of any superimposition by either or both of the hands 1 and 2, and the hands do not therefore interfere with reading of the auxiliary display.

The timepiece further comprises a circuit for controlling the auxiliary displays 5, 6 and 7 which makes it possible at any moment to activate only the auxiliary display which is disposed in the free sector, or one of the two free sectors.

Figure 5:
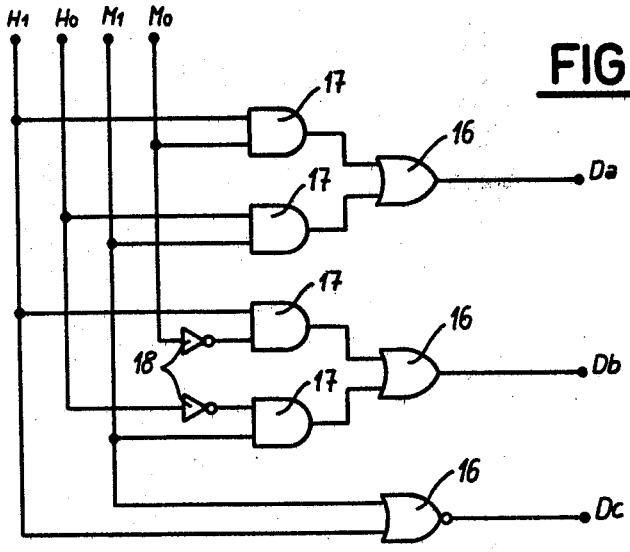
FIG. 5 is a detailed illustrative circuit diagram of a decoder.

The control circuit comprises a divider chain which is fed by the oscillator circuit of the watch which supplies the signal i of one pulse per minute. The divider chain comprises a first divider 8 with a division factor of twenty, which is formed by two stages with division factors of four or five respectively, followed by a stage 9 which provides for division by three and which supplies signals $M_0$ and $M_1$. The division chain also comprises a stage 10 which divides by four and a stage 11 which divides by three and which supplies signals $H_0$ and $H_1$. $M_0$ and $H_0$ are true when the minute and hour hands are respectively in the sector b. $M_1$ and $H_1$ are true when the minute and hour hands are respectively in the sector c. A last stage 12 which divides by two and which supplies one pulse per day supplies a circuit 13 for calculating the date, which is of known design and which supplies a digital display decoder 14, which is also of known design and which supplies the signals for feeding the auxiliary displays 5, 6 and 7. The decoder 14 is controlled by signals Da, Db and Dc for selecting the displays 5, 6 and 7 respectively which is to be activated in dependence on the position of the hands 1 and 2, which is defined by a sector selection decoder 15 supplied with the signals $M_0$, $M_1$ and $H_0$, $H_1$. The decoder 15 is illustrated in FIG. 5 and comprises three OR-gates 16, four AND-gates 17 and two inverters 18.

A zero-resetting control 19 permits initial synchronisation of the division chain 8 to 12 with a given position of the hands, for example midday or midnight, in particular when the battery of the timepiece is changed.

The logic of the sector selection decoder 15 is illustrated by the following table wherein:

$$Da = H_1M_0 + H_0M_1$$

$$Db = H_1\overline{M_0} + \overline{H_0}M_1$$

$$Dc = \overline{H_1M_1} = \overline{H_1} + \overline{M_1}$$

| | INPUTS | | | | OUTPUTS | | |
|---|---|---|---|---|---|---|---|
| | $H_1$ | $H_0$ | $M_1$ | $M_0$ | Da | Db | Dc |
| (1) | 0 | 0 | 0 | 0 | 0 | 0 | 1 |
| (2) | 0 | 0 | 0 | 1 | 0 | 0 | 1 |
| (3) | 0 | 0 | 1 | 0 | 0 | 1 | 0 |
| (4) | 0 | 1 | 0 | 0 | 0 | 0 | 1 |
| (5) | 0 | 1 | 0 | 1 | 0 | 0 | 1 |
| (6) | 0 | 1 | 1 | 0 | 1 | 0 | 0 |
| (7) | 1 | 0 | 0 | 0 | 0 | 1 | 0 |
| (8) | 1 | 0 | 0 | 1 | 1 | 0 | 0 |
| (9) | 1 | 0 | 1 | 0 | 0 | 1 | 0 |

By virtue of the logic of the decoder 14, the auxiliary display which is energized at any moment is that for which the signal D (Da, Db, Dc) corresponding to its sector (a, b, c) is in the 1 state. Thus, the display 5 (sector a) is activated when Da is at state 1, the display 6 (sector b) is activated when Db is at state 1 and the display 7 (sector c) is activated when Dc is at state 1.

Assuming therefore that the hands 1 and 2 are indicating midday and that the division chain 8 to 12 has been set at zero, the mode of operation of the above-described timepiece or watch is as follows:

While the minute hand 2 is in the course of moving to a time of 12.19 p.m., the two hands 1 and 2 are in the sector a; the dividers 9 and 11 which divide by three have not yet received any pulse and the outputs $M_0$, $M_1$ and $H_0$, $H_1$ thereof are all at state 0. In this configuration, either of the displays 6 and 7 of the sectors b and c can be activated. For simplicity of design of the decoder 15, the display 7 of the sector c is activated, and Dc is therefore at state 1. This situation is illustrated by line (1) of the above table.

When the minute hand reaches the time of 12.20 p.m., it passes into the sector b. At the same time, a pulse is applied to the divider 9 and its output $M_0$ goes to state 1. The hands 1 and 2 are then positioned in sectors a and b and the auxiliary display 7 of sector c must be activated. This situation continues until 12.39 p.m., as illustrated by line (2) of the logic table.

At 12.40 p.m., the minute hand 2 passes into the third sector and the divider 9 receives a second pulse which reverses the state of its outputs $M_0$ and $M_1$ ($M_0=0$; $M_1=1$). This condition is represented by line (3) of the table, and it is Db which is at state 1; the display 6 of the sector b is therefore held in an activated condition. This situation continues unitl a time of 12.59 p.m.

At 1.00 p.m., the minute hand 2 passes into the first sector and the divider 9 receives a third pulse which causes it to be reset to zero ($M_0=0$; $M_1=0$). The watch is then again in the situation indicated by line (1) in the table, for which the display is in sector c.

The same cycle is then repeated until a time of 3.59 p.m., the outputs $M_1$ and $M_0$ successively assuming in each hour, for a period of 20 minutes, states 00, 01, and 10, which respectively correspond to activation of the sectors c, c and b.

At 4.00 p.m., the minute hand passes into the sector a and the hour hand passes into the sector b. At that moment, the divider 11 receives its first pulse and its output $H_0$ goes to state 1. The watch is then in the condition defined by line (4) of the table, corresponding to activation of the display of sector c.

The output $H_0$ then remains at state 1 until a time of 7.59 p.m., while the outputs $M_1$ and $M_0$ successively assume in each hour, for a period of 20 minutes, states 00, 01 and 10. This situation corresponds to lines (4), (5) and (6) of the table. The display is thus produced in sector c for the first 40 minutes of the hour and in sector a for the last 20 minutes.

Finally, from 8.00 p.m. to 11.59 p.m., the output $H_0$ is again at state 0, while output $H_1$ is at state 1. As before, the outputs $M_1$ and $M_0$ assume states 00, 01 and 10 cyclically every 20 minutes, which corresponds to lines (7), (8) and (9) of the table. The display is then in sector b for the first 20 minutes and the last 20 minutes of the hour and in sector a for the middle 20 minutes.

A fresh cycle identical to that described above begins at midnight, with the outputs $M_0$, $M_1$, $H_0$ and $H_1$ all being at state 0, as at midday. It will be seen therefore that the time display never masks the auxiliary display which is automatically displaced as between the three sectors a, b and c, in dependence on the position of the hands.

Figure 4:
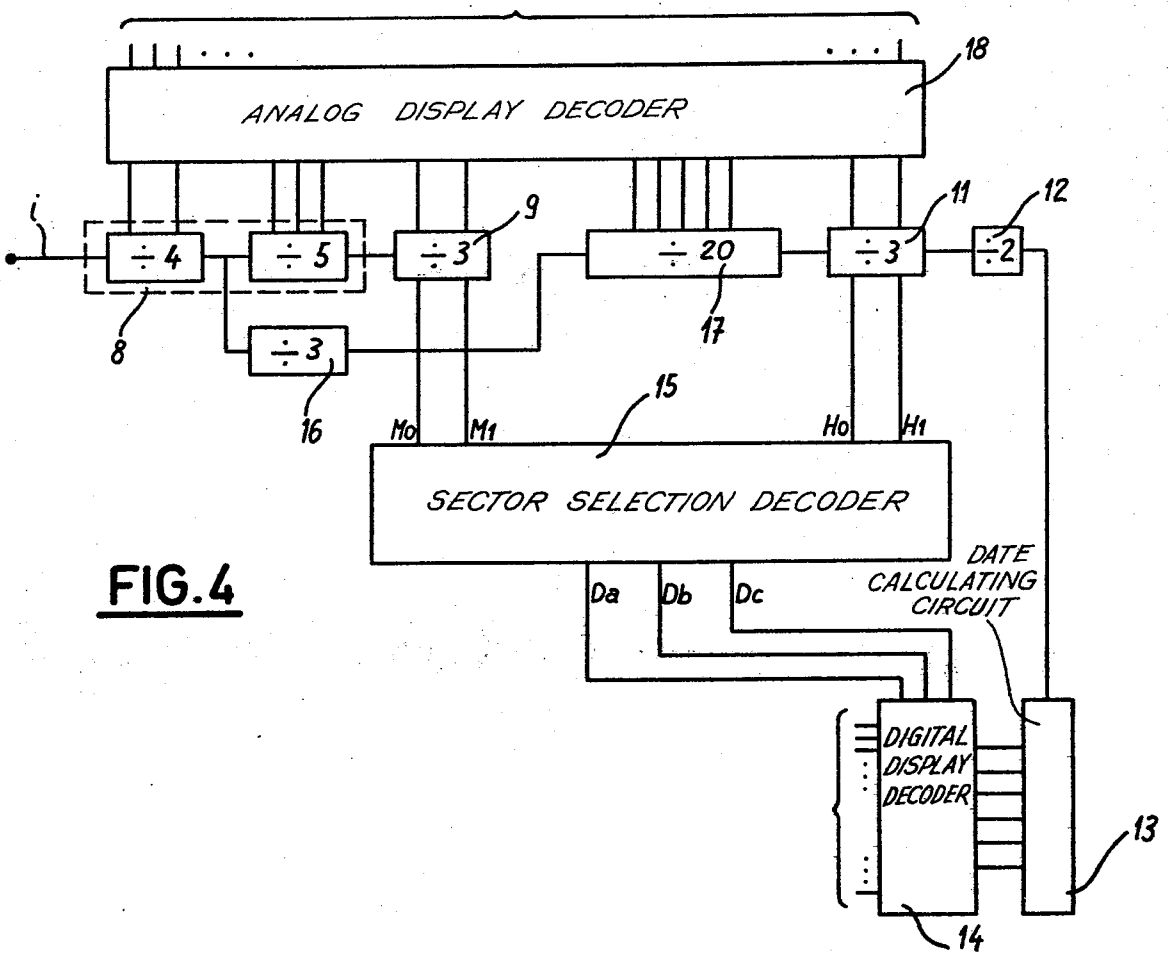
FIG. 4 is a block diagram of part of a timepiece having a pseudo-analog time display and three digital auxiliary displays.

In the second embodiment of the timepiece or watch shown in FIG. 4, the time display is formed by a pseudo-analog display, for example like that described in U.S. Pat. No. 3,959,963.

In a construction of this kind, the divider chain is of a different design in order to permit the production of the signals required for supplying the pseudo-analog display.

The divider chain comprises a first part with a first divider 8 which is formed by two stages with a division factor of four and five respectively, followed by a divider 9 with a division factor of three, for supplying the signals $M_0$ and $M_1$ for feeding the selection decoder 15.

The second part of the divider chain comprises a stage 16 for division by three, which is supplied by the output of the divide-by-four stage of the first divider 8. The divider 16 feeds a divider 17 with a division factor of twenty which supplies a divider 11 with a division factor of three, which provides signals $H_0$ and $H_1$ for supplying the decoder 15. A last stage 12 with a division factor to two supplies one pulse per day, for feeding the date calculating circuit 13.

As in the first embodiment, the means for controlling the auxiliary displays 5, 6 and 7 comprises the decoders 14 and 15. The mode of operation of this control means is identical to that described with reference to the first embodiment. The pseudo-analog time display is controlled by an analog display decoder 18 of known design, which is fed by signals derived from the divider chain 8, 9, 11, 16 and 17. In this case, the divider chain is also fed with a signal of one pulse per minute, provided by the oscillator circuit of the timepiece.

It will be appreciated that it is within the teaching and scope of the present invention to provide more than three auxiliary displays which are disposed in a corresponding number of sectors of the face of the timepiece, correspondingly modifying the logic of the circuit for controlling the displays, so that the activated display is always a display in a clear sector, that is to say, a sector which does not have the time indication therein.

Those skilled in the art will further appreciate that the invention can provide only two sectors and two auxiliary displays which are then disposed in a peripheral region through which the hour hand of the time indicator does not pass. In a simplified design of this kind selection of the auxiliary display depends only on the position of the minute hand.

In this case, the signals $M_0$ and $M_1$ must be supplied by a divider stage with a division ration of two and the stage must receive a pulse every thirty minutes. In this simplified embodiment, the signals $H_0$ and $H_1$ are not required for selecting the auxiliary displays.

Finally, it will be appreciated that the present invention makes it possible to arrive at the desired result with an extremely simplified version (omission of the decoder 15) by providing at least two permanently activated auxiliary displays; however, a construction of this nature is not satisfactory when the timepiece comprises a pseudo-analog time display.

It will be apparent that the auxiliary displays may be provided for displaying something other than dates, e.g., in a watch with a stopwatch or lap counter facility. What is important with the scope of the invention is that all the auxiliary displays are provided for displaying the same parameter but at different moments in order to take into account the position of the time display and to avoid any superimposition of the analog and digital display information.

Various modifications may be made in the form of the invention without departing from the principles disclosed in the foregoing illustrative embodiments. It is intended therefore that the accompanying claims be broadly construed consistent with the prior art.

What is claimed is:

1. An electronic timepiece having a face and comprising an analog time display and a digital auxiliary display visible on said face, said analog time display and said digital auxiliary display being in superimposed relationship such that the analog time display can overlap a portion of the auxiliary display to obscure said portion, said auxiliary display comprising a plurality of digital display means disposed in three sectors of said face which each cover four hours of each half-day, control means for operating said analog time display for enabling time to be visibly indicated in an analog manner on the face of said timepiece and a control circuit for actuating and making fully visible at any given time of day at least one of said digital display means, said control circuit comprising a divider chain for supplying first and second signals when the minutes hand is in two respective ones of said sectors and third and fourth signals when the hour hand is in two respective ones of the sectors and an auxiliary display section decoder which is supplied with said first, second, third and fourth signals and which produces selection signals for activating the displays of the three sectors respectively.

2. A timepiece according to claim 1 wherein the decoder produces the selection signals in accordance with the following table:

$$Da = H_1M_0 + H_0M_1$$

$$Db = H_1\overline{M_0} + \overline{H_0}M_1$$

$$Dc = \overline{H_1M_1} = \overline{H_1} + \overline{M_1}$$

| | INPUTS | | | | OUTPUTS | | |
|---|---|---|---|---|---|---|---|
| | $H_1$ | $H_0$ | $M_1$ | $M_0$ | Da | Db | Dc |
| (1) | 0 | 0 | 0 | 0 | 0 | 0 | 1 |
| (2) | 0 | 0 | 0 | 1 | 0 | 0 | 1 |
| (3) | 0 | 0 | 1 | 0 | 0 | 1 | 0 |
| (4) | 0 | 1 | 0 | 0 | 0 | 0 | 1 |
| (5) | 0 | 1 | 0 | 1 | 0 | 0 | 1 |
| (6) | 0 | 1 | 1 | 0 | 1 | 0 | 0 |
| (7) | 1 | 0 | 0 | 0 | 0 | 1 | 0 |
| (8) | 1 | 0 | 0 | 1 | 1 | 0 | 0 |
| (9) | 1 | 0 | 1 | 0 | 0 | 1 | 0 |

* * * * *